US012760519B2

(12) United States Patent
Crookston

(10) Patent No.: US 12,760,519 B2
(45) Date of Patent: Oct. 13, 2026

(54) GUTTER BRACKET

(71) Applicant: Charles Augustine Crookston, Kalamazoo, MI (US)

(72) Inventor: Charles Augustine Crookston, Kalamazoo, MI (US)

( * ) Notice: Subject to any disclaimer, the term of this patent is extended or adjusted under 35 U.S.C. 154(b) by 0 days.

(21) Appl. No.: 18/827,991

(22) Filed: Sep. 9, 2024

(65) Prior Publication Data

US 2025/0230659 A1 Jul. 17, 2025

Related U.S. Application Data

(63) Continuation of application No. 18/411,613, filed on Jan. 12, 2024, now Pat. No. 12,084,867.

(51) Int. Cl.
*E04D 13/00* (2006.01)
*E04D 13/072* (2006.01)

(52) U.S. Cl.
CPC ..... *E04D 13/0722* (2013.01)

(58) Field of Classification Search
None
See application file for complete search history.

(56) References Cited

U.S. PATENT DOCUMENTS 707,941 A * 8/1902 Pope ..... E04D 13/0722 248/48.1
869,195 A * 10/1907 Patchin ..... E04D 13/0725 D25/199
1,392,966 A 10/1921 Rachlin
1,855,241 A 4/1932 Irwin
2,536,704 A 1/1951 Sjea et al.
2,565,090 A 8/1951 Ramser
3,022,029 A 2/1962 Blayden
(Continued)

FOREIGN PATENT DOCUMENTS

CH 655756 A 5/1986
CH 671258 A5 8/1989
(Continued)

OTHER PUBLICATIONS

Bespoke Guttering, "The Various Sytles of Gutter," 2023, pp. 1-3.
(Continued)

*Primary Examiner* — Steven M Marsh
(74) *Attorney, Agent, or Firm* — Kintner IP, LLC; Mary Frances Ludwig

(57) ABSTRACT

A gutter bracket designed for a half round gutter includes a mounting portion with a flat mounting surface positioned behind one or more rear gutter retaining tabs. The gutter bracket includes a gutter supporting portion that is shaped and sized to accommodate the half round gutter. Within the gutter supporting portion there is a rib positioned between two wings that make contact with the half round gutter. The rib is open upwardly between the two wings. A front gutter retaining portion extends forwardly from the gutter supporting portion and has a front gutter retaining tab for bending around the front edge of the half round gutter. These features provide structural strength to support the gutter, especially under heavy loads such as snow. The gutter bracket also improves ease of installation of gutter systems.

17 Claims, 15 Drawing Sheets

(56) References Cited

U.S. PATENT DOCUMENTS

| | | | | |
|---|---|---|---|---|
| 4,036,369 | A * | 7/1977 | Eisenberg | A47B 45/00 248/48.2 |
| 4,776,544 | A | 10/1988 | Williams | |
| 5,098,045 | A | 3/1992 | Pepper | |
| 5,687,936 | A | 11/1997 | Wilson | |
| 5,845,435 | A | 12/1998 | Knudson | |
| 6,651,937 | B1 | 11/2003 | Wilson | |
| 7,891,141 | B2 * | 2/2011 | Kennedy | E04D 13/0725 52/12 |
| 9,624,673 | B2 | 4/2017 | Conner | |
| 10,267,043 | B2 | 4/2019 | Conner | |
| 2005/0082436 | A1 | 4/2005 | Snell | |
| 2014/0019640 | A1 | 1/2014 | Fitchett | |
| 2016/0333589 | A1 | 11/2016 | Zondlak | |

FOREIGN PATENT DOCUMENTS

| | | | | |
|---|---|---|---|---|
| EP | 1340864 | A1 * | 9/2003 | E04D 13/0722 |
| EP | 3862504 | A1 * | 8/2021 | E04D 13/0722 |
| FR | 934657 | A | 5/1948 | |
| FR | 2216417 | A1 | 8/1974 | |
| FR | 2425515 | A1 | 12/1979 | |
| FR | 2563263 | A1 | 10/1985 | |
| FR | 2571411 | A1 | 4/1986 | |
| GB | 191225692 | A | 3/1913 | |
| GB | 2145754 | A | 4/1985 | |
| GB | 2433077 | A | 6/2007 | |
| WO | WO-9724497 | A1 * | 7/1997 | E04D 13/0641 |

OTHER PUBLICATIONS

Extended European Search Report received in European Application No. 25150969.1 dated Apr. 8, 2025, pp. 7.

English translation of FR2425515 previously submitted, pp. 1-3.

* cited by examiner

GUTTER BRACKET

CROSS REFERENCE TO RELATED APPLICATION

This application is a continuation of U.S. patent application Ser. No. 18/411,613, filed Jan. 12, 2024, which is hereby incorporated in its entirety.

TECHNICAL FIELD

The present invention pertains generally to gutter hanging, and more particularly to gutter brackets and gutter bracket systems for half round gutters.

BACKGROUND OF THE INVENTION

Existing gutter brackets do not provide adequate support for half round gutter, which, due to its semi-circular profile, has a relatively low amount of surface area in contact with the structure from which it is hung. These existing brackets therefore have a tendency to bend downwardly if the gutter is subject to heavy loading conditions, such as from snow, ice, accumulated debris, or the like.

In addition, sometimes gutter brackets are affixed to the gutter prior to being fastened to a structure (e.g., while the gutter is on the ground). In this situation, it is common for the installer to not use all of the fasteners that the gutter bracket is designed for, as some fastener apertures of the gutter bracket may not be accessible once the bracket is affixed to the gutter. The brackets may therefore not provide the strength and rigidity that they would have if properly installed.

There is therefore a need for a gutter bracket that provides improved support for a half round gutter. There is also a need to improve ease of installation of gutter brackets.

BRIEF SUMMARY OF THE EMBODIMENTS

Embodiments disclosed herein are directed to a gutter bracket and gutter support systems, particularly for hanging half round gutter. The gutter bracket is designed to provide structural strength to support the gutter, especially under heavy loads such as snow, ice, accumulated debris, and the like. Additional features of the gutter bracket improve ease of installation of gutter systems by allowing the bracket to be affixed to the gutter prior to installation on a structure, such as the fascia of a building. The gutter bracket includes a mounting portion with a flat mounting surface positioned behind one or more rear gutter retaining tabs. The gutter bracket also includes a gutter supporting portion that is shaped and sized to accommodate the half round gutter. Within the gutter supporting portion, there is a rib positioned between two wings that make contact with the half round gutter. The rib is open upwardly between the two wings. A front gutter retaining portion extends forwardly from the gutter supporting portion and includes a front gutter retaining tab for bending around the front edge of the half round gutter. A gutter bracket system may include a wedge configured for mounting the gutter bracket to an angled surface.

According to one or more embodiments, a gutter bracket is structurally configured to cooperate with a structure, a fastener, and a half round gutter having a front edge. The gutter bracket includes: a mounting portion including a substantially flat mounting surface offset rearwardly from one or more rear gutter retaining tabs; a mounting aperture in the mounting surface, the mounting aperture configured to receive the fastener therethrough for mounting the gutter bracket to the structure; a gutter supporting portion shaped and dimensioned to receive the half round gutter; a rib in the gutter supporting portion; two wings arranged with the rib therebetween, the two wings configured to contact the half round gutter; wherein the rib is open between the two wings; and a front gutter retaining portion extending forwardly from the gutter supporting portion, the front gutter retaining portion including a front gutter retaining tab configured for bending around the front edge of the half round gutter.

According to one or more embodiments of the gutter bracket, the rib is open between the two wings along an entire length of the gutter supporting portion.

According to one or more embodiments of the gutter bracket, the two wings extend along an entire length of the gutter supporting portion.

According to one or more embodiments, the gutter bracket further includes two rear gutter retaining tabs, each rear gutter retaining tab tapering inwardly and abutting one of the two wings.

According to one or more embodiments, the gutter bracket further includes a slit located adjacent each rear gutter retaining tab, and the slit has a slit bottom and an open slit top.

According to one or more embodiments of the gutter bracket, the mounting aperture is located intermediate two rear gutter retaining tabs and above the slit bottom.

According to one or more embodiments, the gutter bracket further includes a single mounting aperture in the mounting surface.

According to one or more embodiments of the gutter bracket, the gutter supporting portion has a substantially semi-circular cross-section.

According to one or more embodiments, the gutter bracket is unitarily formed.

According to one or more embodiments, the gutter bracket further includes a single front gutter retaining tab.

According to one or more embodiments of the gutter bracket, the mounting surface is substantially flat along a distance extending below an upper rear edge of the two wings.

According to one or more embodiments, a gutter bracket is structurally configured to cooperate with a structure and a half round gutter having a front edge, the gutter bracket including: a mounting portion including a substantially flat mounting surface offset rearwardly from one or more rear gutter retaining tabs; a gutter supporting portion shaped and dimensioned to receive the half round gutter; a rib in the gutter supporting portion; two wings arranged with the rib therebetween, the two wings configured to contact the half round gutter; wherein the rib extends downwardly below the two wings; and a front gutter retaining portion extending forwardly from the gutter supporting portion.

According to one or more embodiments, a gutter bracket is structurally configured to cooperate with a structure and a half round gutter having a front edge, the gutter bracket including: a mounting portion including a substantially flat mounting surface offset rearwardly from one or more rear gutter retaining tabs, and two sidewalls adjacent the mounting surface; a gutter supporting portion shaped and dimensioned to receive the half round gutter; a rib in the gutter supporting portion; two wings arranged with the rib therebetween, the two wings configured to contact the half round gutter; wherein the two sidewalls are inwardly tapered from a bracket top to the rib; and a front gutter retaining portion extending forwardly from the gutter supporting portion.

According to one or more embodiments, a gutter bracket is structurally configured to cooperate with a structure and a half round gutter having a front edge, the gutter bracket including: a mounting portion including a substantially flat mounting surface offset rearwardly from one or more rear gutter retaining tabs; a gutter supporting portion shaped and dimensioned to receive the half round gutter; a rib in the gutter supporting portion; two wings arranged with the rib therebetween, the two wings having a curvature shaped to conform to the half round gutter; and a front gutter retaining portion extending forwardly from the gutter supporting portion.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the gutter bracket are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

The detailed description describes non-limiting exemplary embodiments. Any individual features may be combined with other features as required by different applications for at least the benefits described herein. As used herein, the term "about" means plus or minus 10% of a given value unless specifically indicated otherwise. As used herein, the terms "substantially" or "substantially the same" mean that two items are at least 90% the same; for example, a feature described as "substantially parallel" may be parallel to within 90%, an element described as "substantially circular" may be circular to within 90%, and so on.

As used herein, the conjunction "or" is to be construed inclusively (e.g., "A or B" would be interpreted as "A, or B, or both A and B"; e.g., "A, B, or C" would be interpreted as "A; or B; or C; or any two of A, B, and C; or all three of A, B, and C").

As used herein, disclosure of a singular element is also a disclosure of a plural element and vice versa unless otherwise noted.

In the present disclosure, many features are described as being optional, e.g. through the use of the verb "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features, or with all three of the three possible features.

Figure 1:
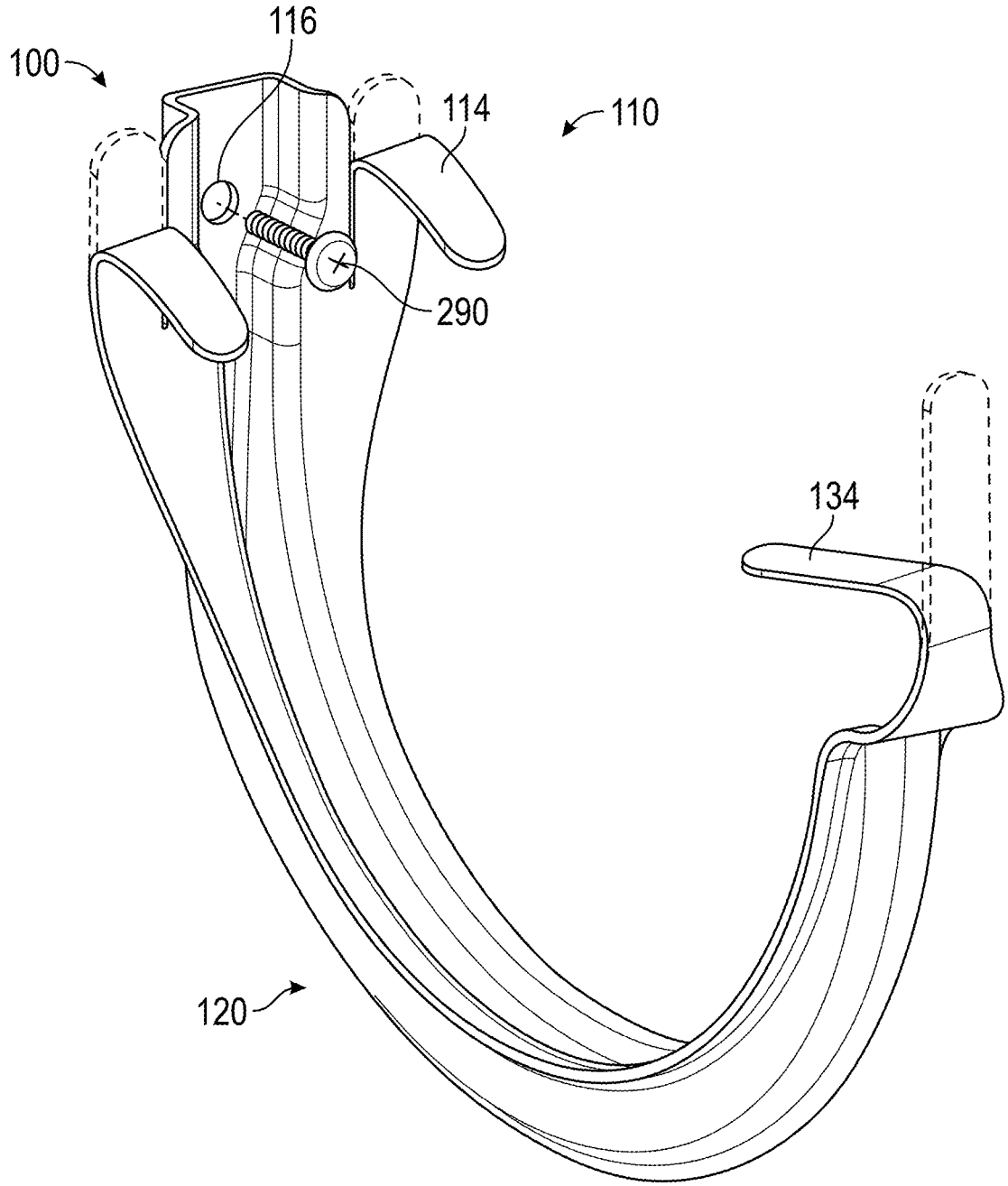
FIG. 1 is an example illustration of an embodiment of a gutter bracket.

FIG. 1 is an example illustration of an embodiment of a gutter bracket 100 that is structurally configured for hanging a half round gutter. Gutter bracket 100 includes a mounting portion 110 configured for mounting to a structure, such as the fascia of a building. A gutter supporting portion 120 extends forwardly from mounting portion 110 and is shaped and dimensioned to receive a section of gutter, such as a half round gutter. One or more rear gutter retaining tabs 114 and a front gutter retaining tab 134 may be used to retain the gutter by bending the tabs around an edge of the gutter. In FIG. 1, rear gutter retaining tabs 114 and front gutter retaining tab 134 are illustrated in alternate configurations: unbent (in dashed lines) and bent (in solid lines). As used herein, the term "rear", or similar, refers to the direction of the structure to which the gutter bracket is to be mounted, while the term "front", or similar, refers to the direction away from said structure.

Figure 2:
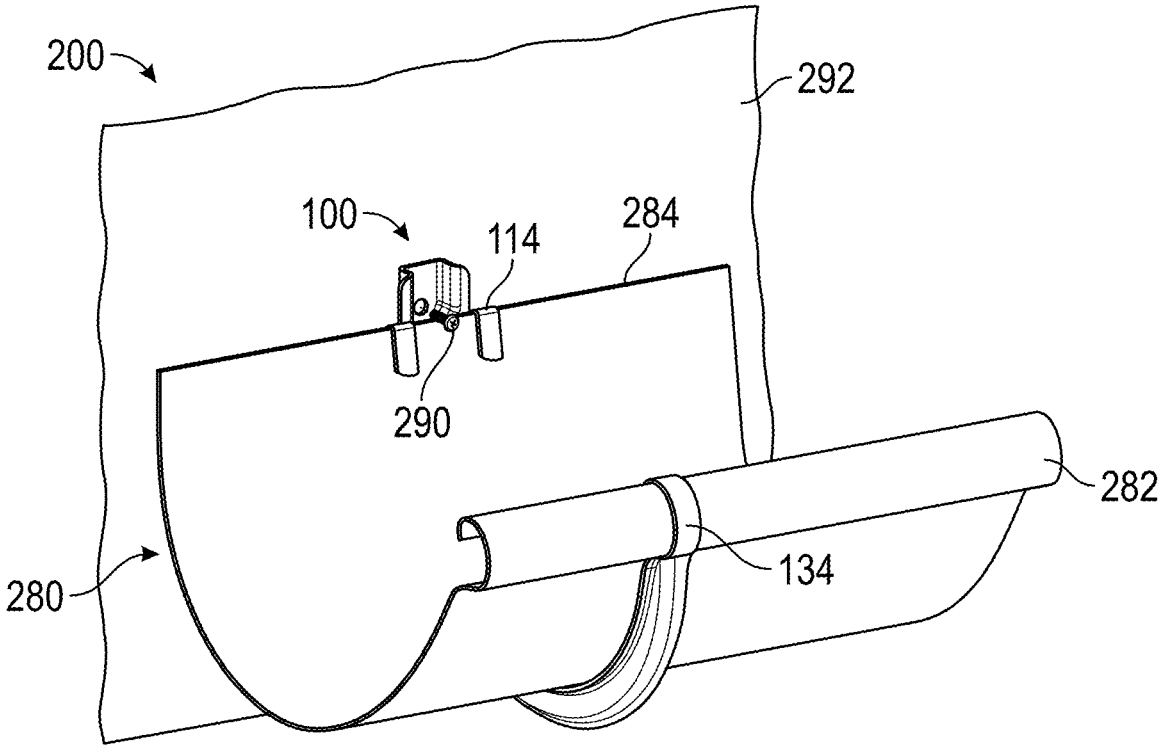
FIG. 2 is an example illustration of an embodiment of a gutter bracket system shown in use with a half round gutter.
Figure 3:
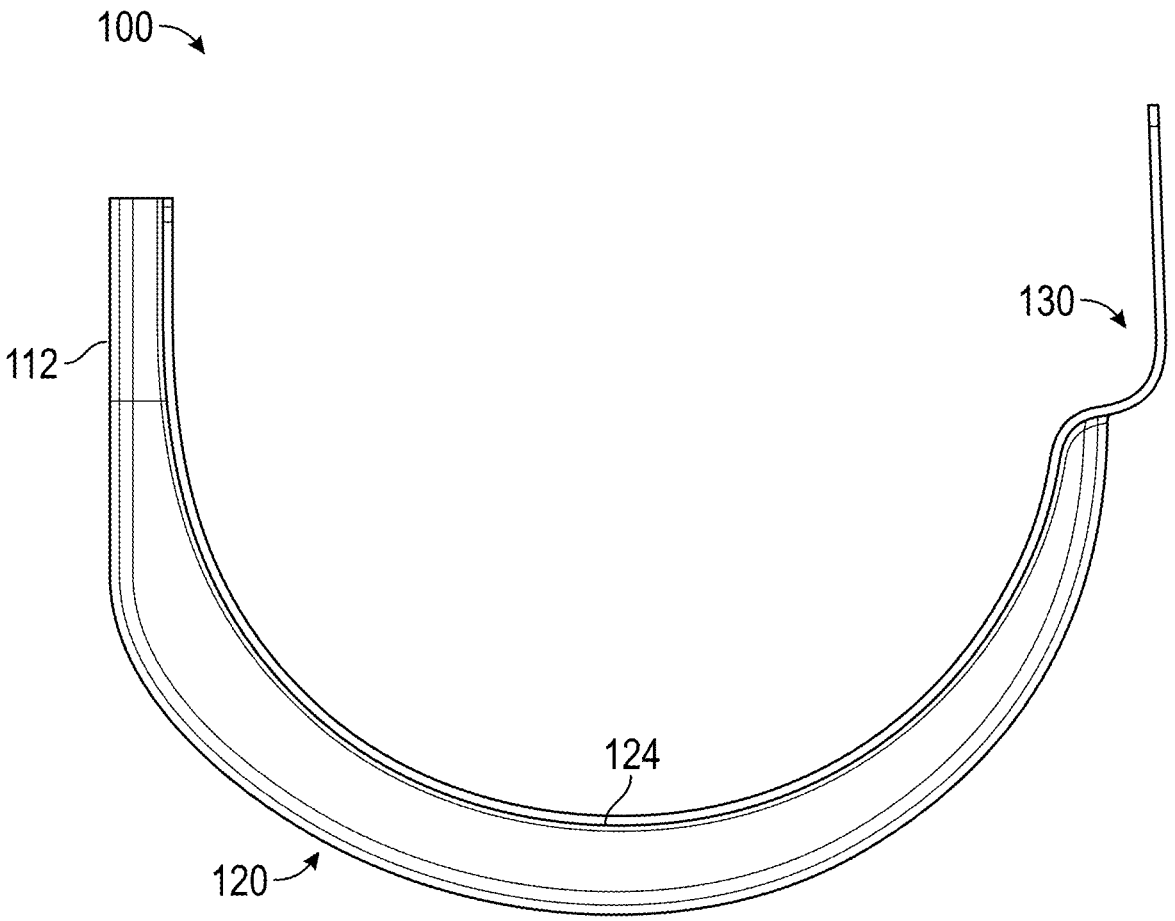
FIG. 3 is an example illustration of a first side elevation view of an embodiment of the gutter bracket, the second side elevation view being a mirror image.

FIG. 2 is an example illustration of an embodiment of a gutter bracket system 200 shown in use with a gutter 280 (such as a half round style of gutter). The shown gutter bracket system may also be referred to herein as a gutter support system, a gutter system, or simply a system. System 200 may include one or more gutter brackets (e.g., gutter bracket 100 as described in FIG. 1) and one or more fasteners 290. Fastener 290 is received through a mounting aperture 116 located in the mounting portion 110 of gutter bracket 100 (see also FIG. 1), and used to fasten gutter bracket 100 to a structure 292. Gutter 280 has a front edge 282 (for example, a reverse bead) and front gutter retaining tab 134 may be structurally configured for bending around front edge 282 so as to retain gutter 280 within gutter bracket 100. Gutter 280 also has a rear edge 284, and rear gutter retaining tabs 114 may be structurally configured for bending around rear edge 284.

FIGS. 3-8 are example illustrations of first side elevation, top and bottom plan, front and rear elevation, and cross-sectional views, respectively, of an embodiment of gutter bracket 100. Mounting portion 110 of gutter bracket 100 includes a mounting surface 112 which is substantially flat and generally oriented vertically when in use (e.g., mounting surface 112 may generally abut a structure, such as a fascia). This configuration provides support for the gutter and resists bending under heavy loads, such as snow, ice, or the like. This feature is particularly beneficial for supporting a half round gutter, which, due to its semi-circular shape, may otherwise have only a limited region in contact with a structure and/or support. In some cases, mounting surface 112 may be substantially flat along a distance, D1 (see, e.g., FIG. 8), which extends below an upper rear edge 128 of the two wings 124 (where upper rear edge 128 is the region of the wing configured to contact the uppermost rear edge of the gutter). Said another way, within a region below rear gutter retaining tabs 114, mounting surface 112 may be substantially flat and vertical, while two wings 124 are curved (e.g., curved substantially complementary to a half round gutter).

Gutter supporting portion 120 includes a rib 122 and two wings 124 arranged one on either side of the rib 122. Rib 122 may extend downwardly from the two wings 124 and may have an open top 126 between the two wings 124 (see, e.g., FIG. 4 and FIG. 8). In this configuration, the two wings 124 are configured to contact the gutter, and rib 122 provides additional structural support. In some cases, rib 122 may be open between the two wings 124 along the entire length, L1, of gutter supporting portion 120 (see FIG. 4). In addition, or instead, the two wings 124 may extend along the entire length, L1, of gutter supporting portion 120. In the shown embodiment, gutter supporting portion 120 has a substantially semi-circular cross-section (see, e.g., FIG. 8), although other shapes are possible as may be desired to support a gutter having a different profile. In general, it is desirable that the two wings 124 are shaped substantially complementary to an outer profile of the gutter, so as to provide contact and support along the width of the gutter. In some embodiments, one or more holes may be provided at a low point of gutter supporting portion 120 (see, e.g., the weep hole 129 shown in FIGS. 4-5). Weep hole 129 allows water that may seep into gutter bracket 100 to drain out.

Figure 4:
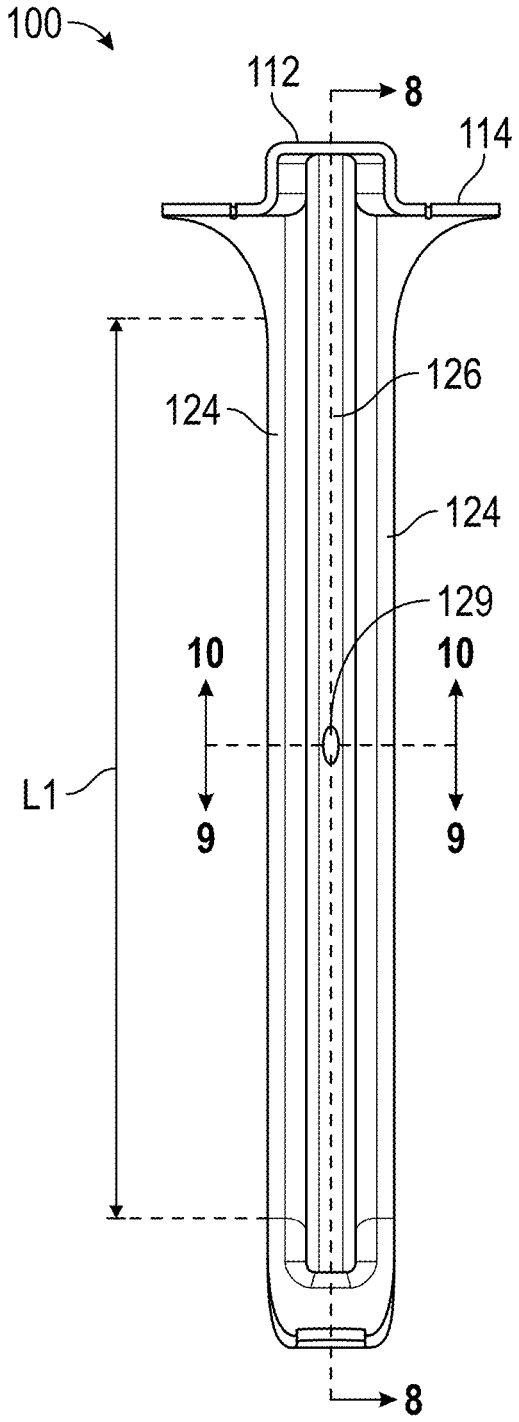
FIG. 4 is an example illustration of a top plan view of an embodiment of the gutter bracket.
Figure 5:
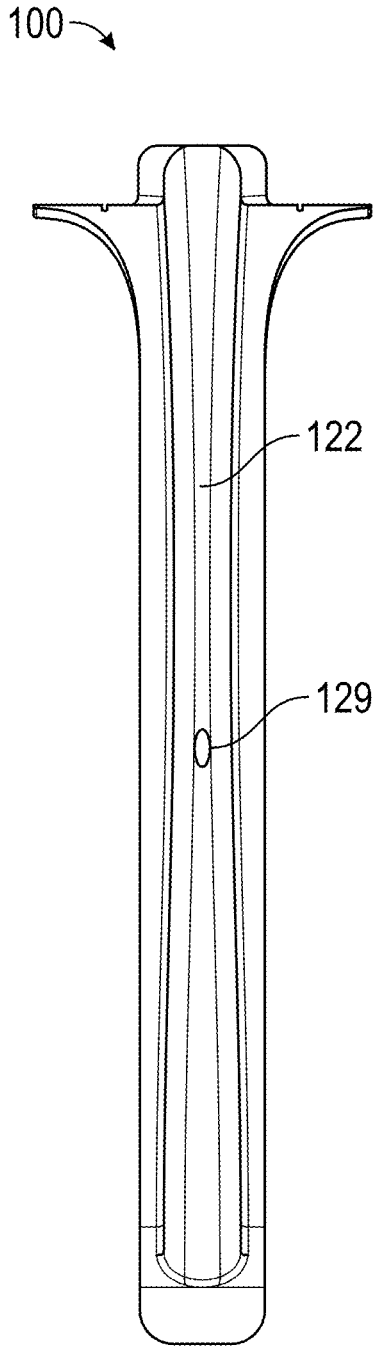
FIG. 5 is an example illustration of a bottom plan view of an embodiment of the gutter bracket.

Mounting surface 112 of mounting portion 110 may be offset rearwardly from rear gutter retaining tabs 114 (see, e.g., FIG. 4). A slit 118 may be located adjacent each rear gutter retaining tab 114 (see, e.g., FIG. 7). Each slit 118 may have an open slit top 117. Slit 118 is configured to permit bending of rear gutter retaining tab 114 (e.g., bending downwardly away from mounting surface 112 over a rear edge of the gutter, see FIG. 2). Mounting aperture 116 may be located within mounting surface 112 intermediate two rear gutter retaining tabs 114, and may also be located above a slit bottom 119 of slit 118. This positioning of mounting aperture 116 allows mounting aperture 116 to remain exposed for access when gutter bracket 100 is in use with a gutter; therefore gutter bracket 100 may be affixed to a gutter (e.g., gutter 280 of FIG. 2) while the gutter is on the ground. The gutter, with one or more of gutter bracket 100 affixed thereto, may then be hung from a structure (e.g., structure 292 of FIG. 2) by inserting a fastener (e.g., fastener 290 of FIG. 2) through mounting aperture 116 and driving the fastener into the structure. In some embodiments, only a single mounting aperture 116 may be present in mounting surface 112; this feature may simplify installation of a gutter system.

Front gutter retaining portion 130 extends forwardly from gutter supporting portion 120 and includes front gutter retaining tab 134. While a single front gutter retaining tab 134 is shown in the present embodiment, more than one front gutter retaining tab may instead be present in other embodiments.

Figure 6:
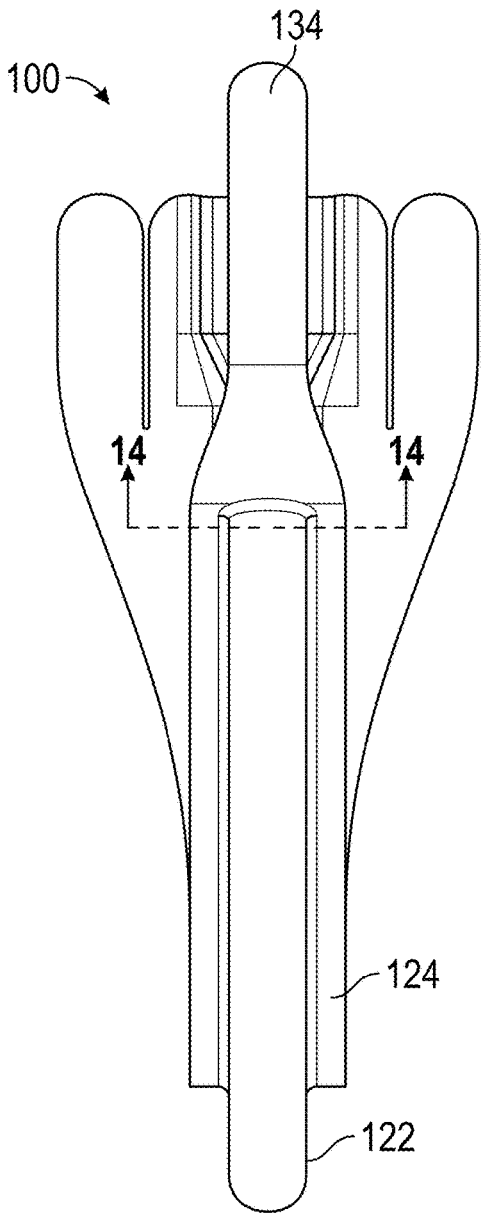
FIG. 6 is an example illustration of a front elevation view of an embodiment of the gutter bracket.
Figure 7:
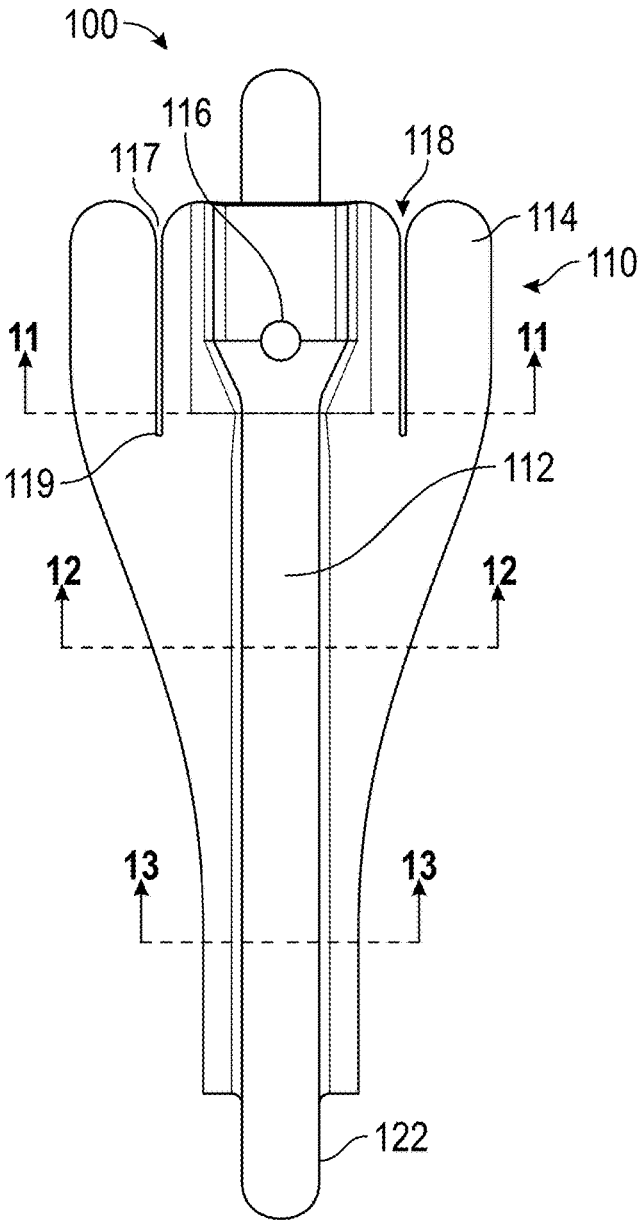
FIG. 7 is an example illustration of a rear elevation view of an embodiment of the gutter bracket.
Figure 8:
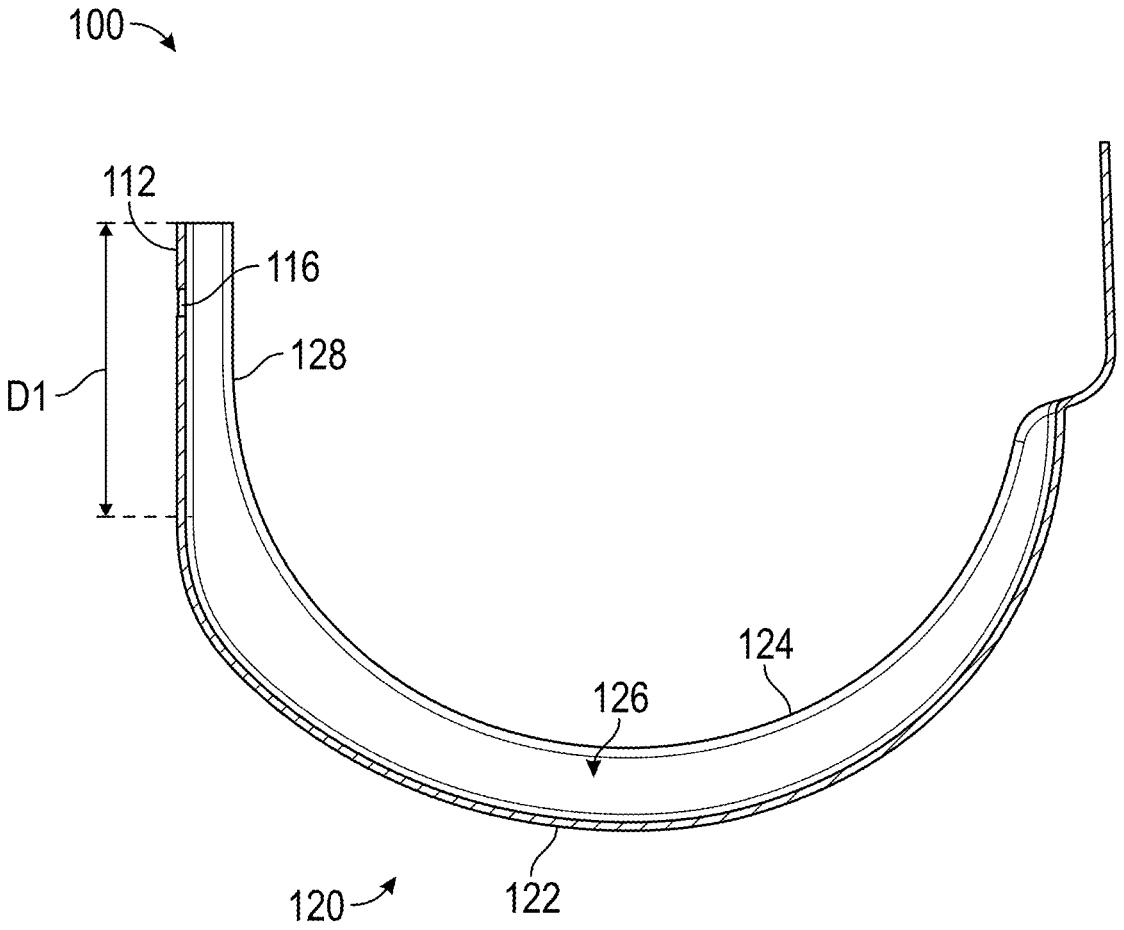
FIG. 8 is an example illustration of a cross-sectional view along the line 8-8 of FIG. 4.
Figure 9:
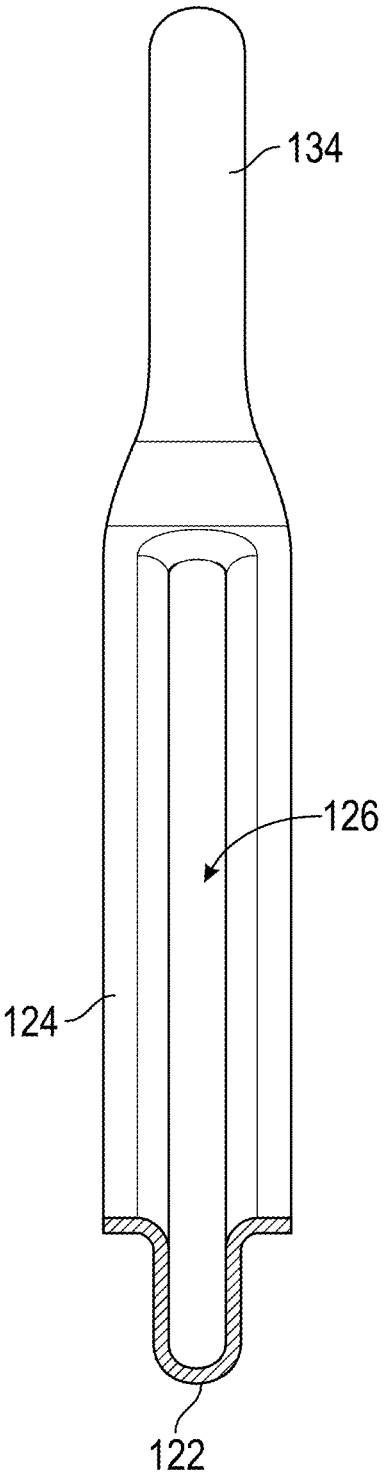
FIG. 9 is an example illustration of an enlarged cross-sectional view along the line 9-9 of FIG. 4.
Figure 10:
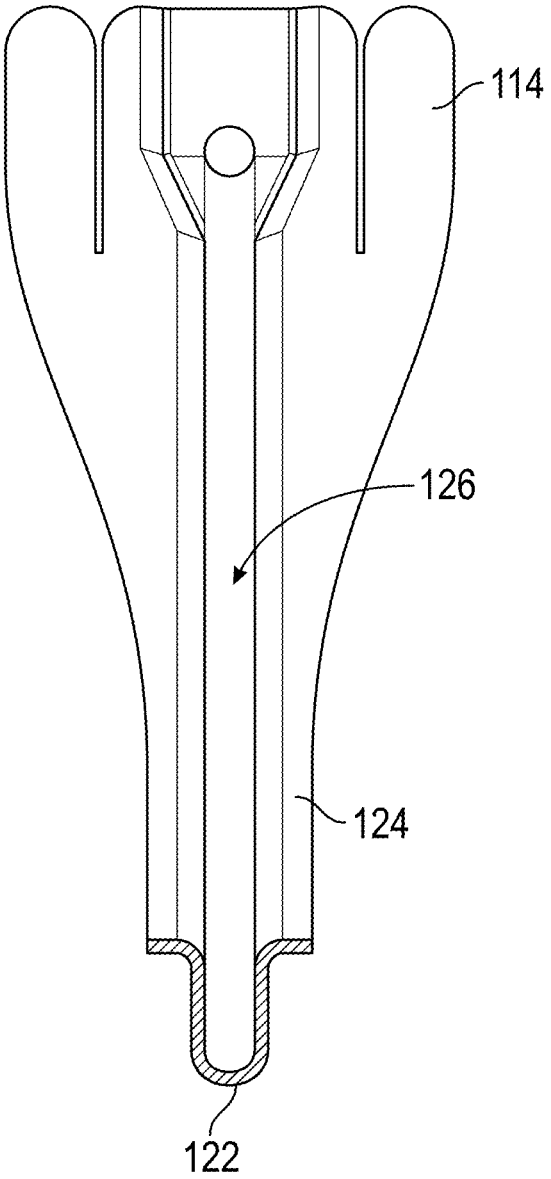
FIG. 10 is an example illustration of an enlarged cross-sectional view along the line 10-10 of FIG. 4.
Figure 11:
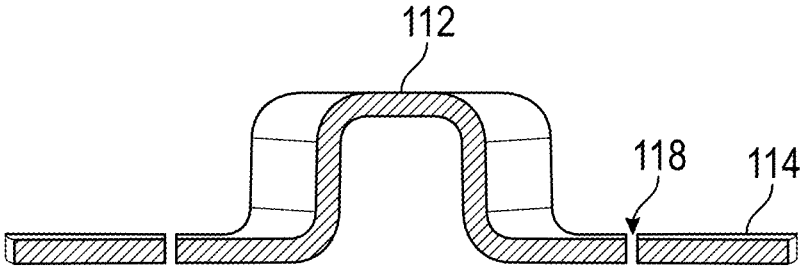
FIG. 11 is an example illustration of an enlarged cross-sectional view along the line 11-11 of FIG. 7.
Figure 12:
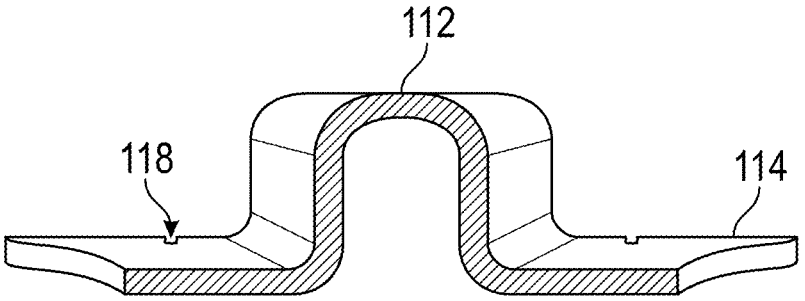
FIG. 12 is an example illustration of an enlarged cross-sectional view along the line 12-12 of FIG. 7.
Figure 13:
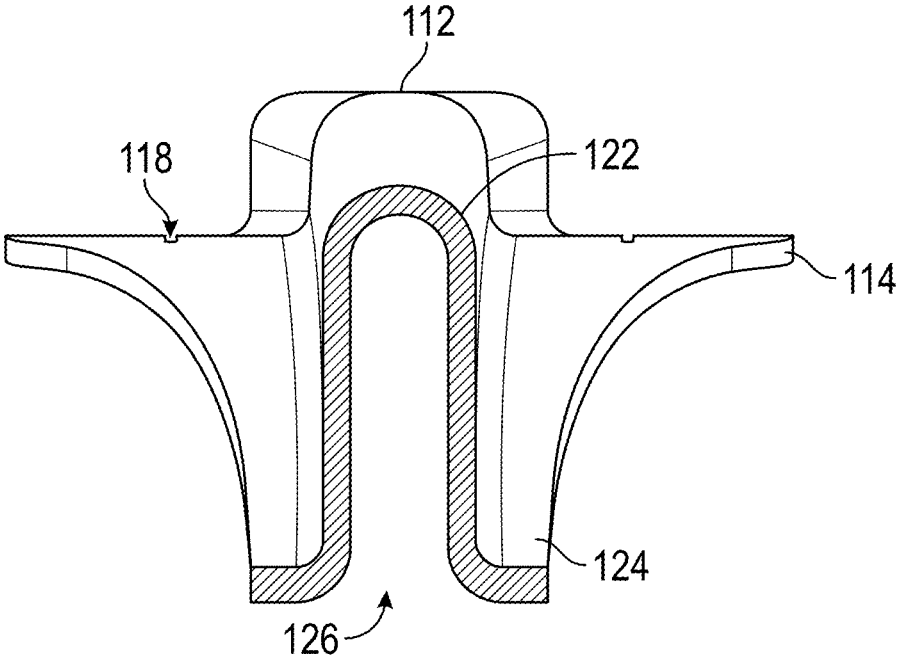
FIG. 13 is an example illustration of an enlarged cross-sectional view along the line 13-13 of FIG. 7.
Figure 14:
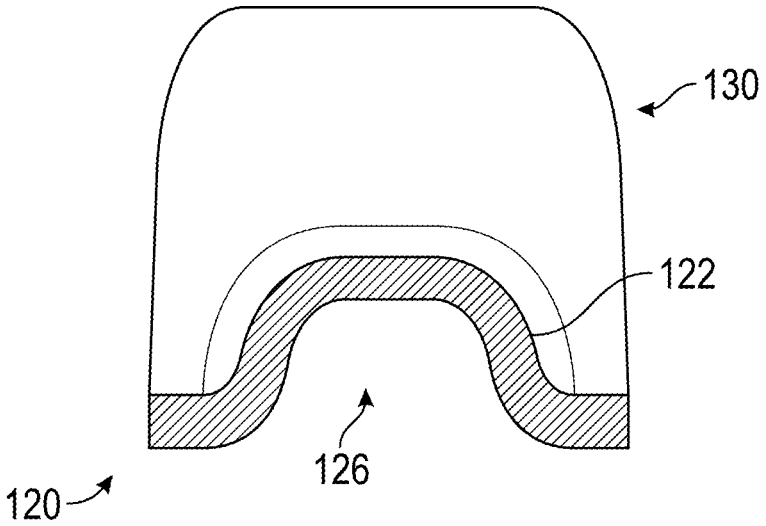
FIG. 14 is an example illustration of an enlarged cross-sectional view along the line 14-14 of FIG. 6.

FIGS. 9-14 are example illustrations of enlarged cross-sectional views of the gutter bracket, taken along the section lines of FIGS. 4, 6, and 7, where the section lines are numbered in correspondence with the related Figure. Certain features of gutter bracket 100 may be more clearly understood with reference to the cross-sectional views. For instance, an example profile of rib 122 and open top 126 may be clearly seen in FIGS. 9, 10, and 13; a region where rear gutter retaining tabs 114 taper inwardly to abut the two wings 124 may be seen in FIGS. 12-13; the substantially flat mounting surface 112 and the transition between mounting surface 112 and rib 122 may be seen in FIGS. 11-13; and two slits 118 are shown in FIGS. 11-13. FIG. 14 shows the transition between gutter supporting portion 120 and front gutter retaining portion 130; including where the open top 126 of rib 122 transitions to the front gutter retaining tab (hidden in this view).

In the shown embodiment, mounting portion 110, gutter supporting portion 120, and front gutter retaining portion 130 of gutter bracket 100 are unitarily formed (e.g., of single-piece construction). Gutter bracket 100 may, for example, be manufactured by stamping, cutting, or otherwise forming a blank which may be formed to the desired shape. Other suitable manufacturing processes may be used to achieve an equivalent result. Gutter bracket 100 may be constructed of any material of suitable strength, such as aluminum sheet metal.

In some embodiments, gutter bracket 100 may cooperate with a fastener 290 to form a gutter bracket system 200 (refer, e.g., to FIG. 2). One or more of fastener 290 (such as a screw, or similar) may be packaged with one or more of gutter bracket 100 to gutter bracket system 200 suitable for supporting one or more sections of gutter. In some cases, fastener 290 may be retained within mounting aperture 116 (e.g., fastener 290 may be a captive screw).

Further provided is a gutter system including (refer, e.g., to FIG. 2) a gutter 280 (e.g., one or more sections of half round gutter), one or more of gutter bracket 100, and one or more of fastener 290.

Figure 15:
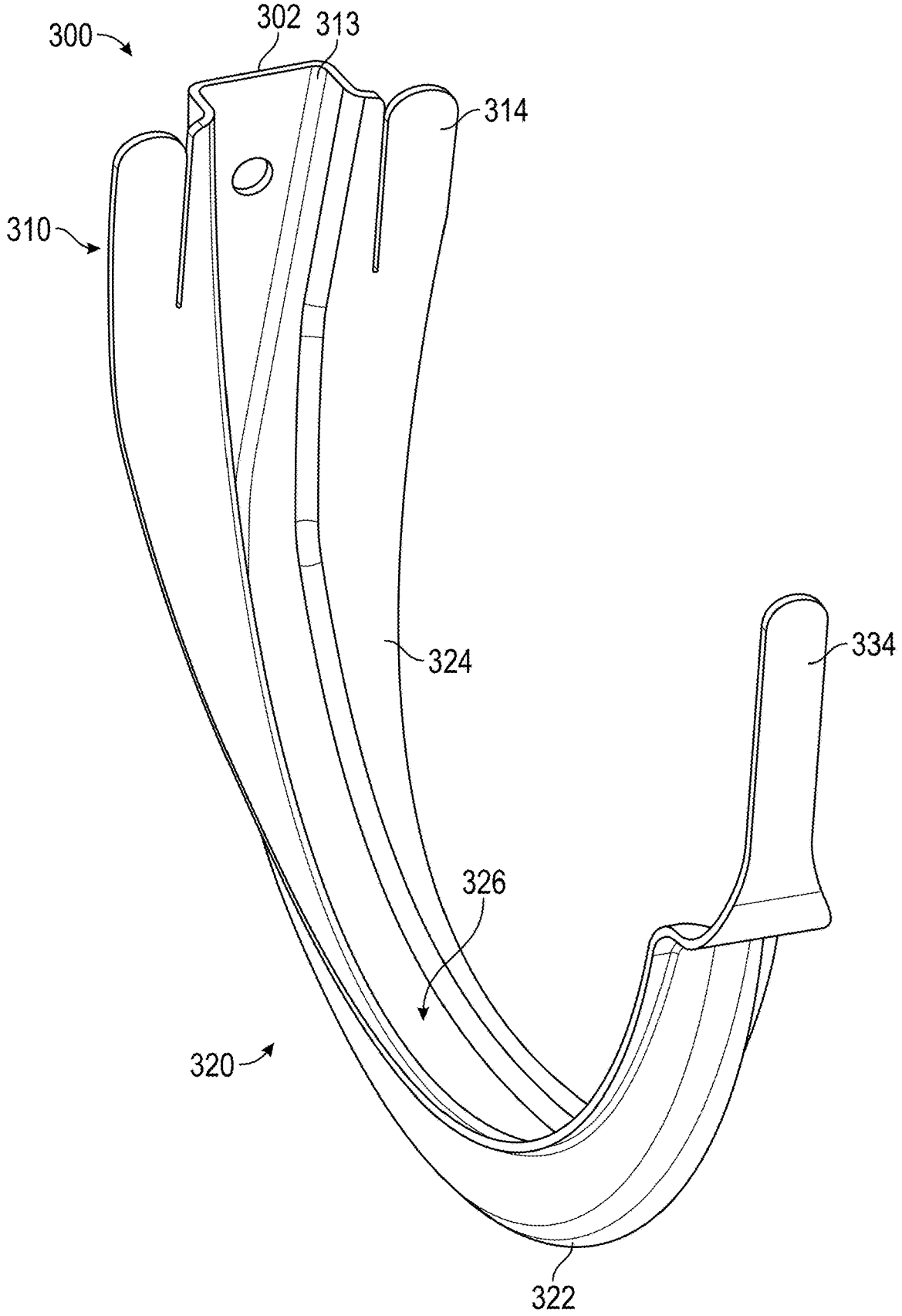
FIG. 15 is an example illustration of an embodiment of a gutter bracket.
Figure 16:
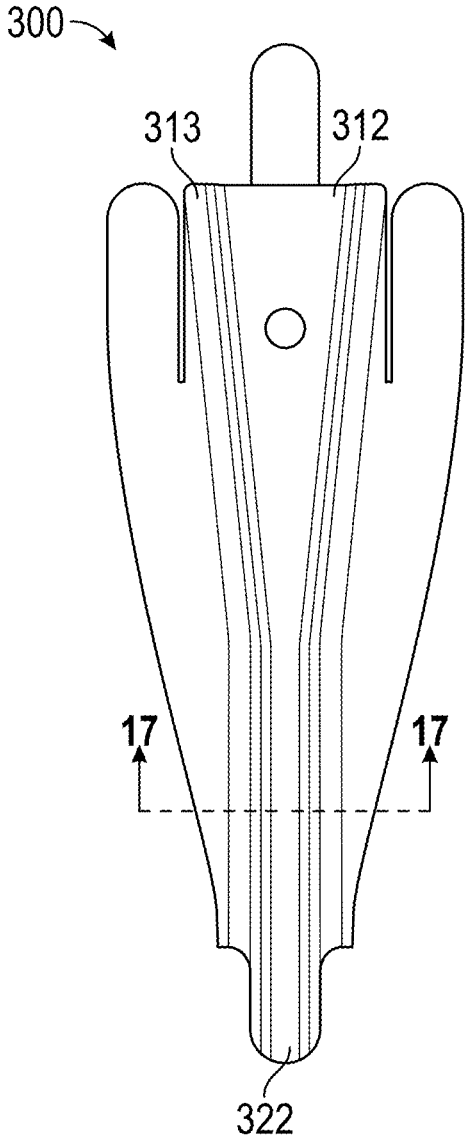
FIG. 16 is an example illustration of a rear elevation view of the embodiment of FIG. 15.
Figure 17:
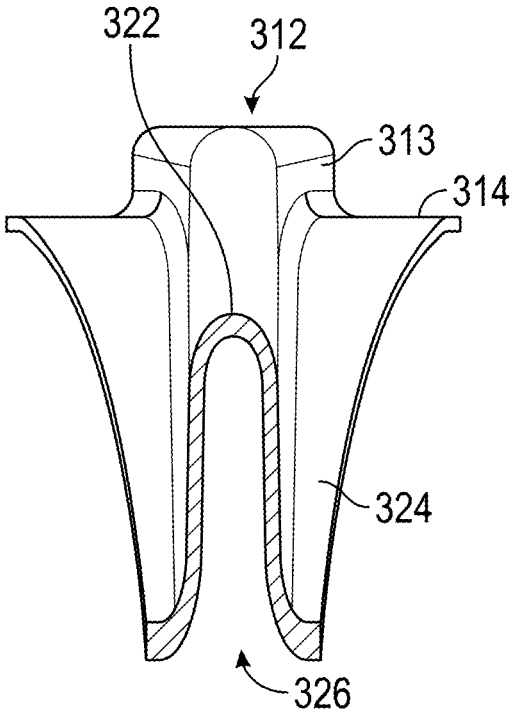
FIG. 17 is an example illustration of an enlarged cross-sectional view along the line 17-17 of FIG. 16.

FIGS. 15-17 are example illustrations of perspective, rear elevation, and enlarged cross-sectional views of another embodiment of a gutter bracket, designated as gutter bracket 300. Features of the shown embodiment of gutter bracket 300 may be the same as, or similar to, features described elsewhere herein, for example, with reference to gutter bracket 100 of FIGS. 38. Gutter bracket 300 includes a mounting portion 310 configured for mounting to a structure, such as the fascia of a building. A gutter supporting portion 320 extends forwardly from mounting portion 310 and is shaped and dimensioned to receive a section of gutter, and may include two wings 324 and a rib 322 with an open top 326. One or more rear gutter retaining tabs 314 and a front gutter retaining tab 334 may be used to retain the gutter, in a manner similar to other embodiments described herein. A mounting surface 312 may be substantially flat and substantially vertical. Sidewalls 313 adjacent mounting surface 312 may have a continuous inward taper from a bracket top 302 to rib 322.

Figure 18:
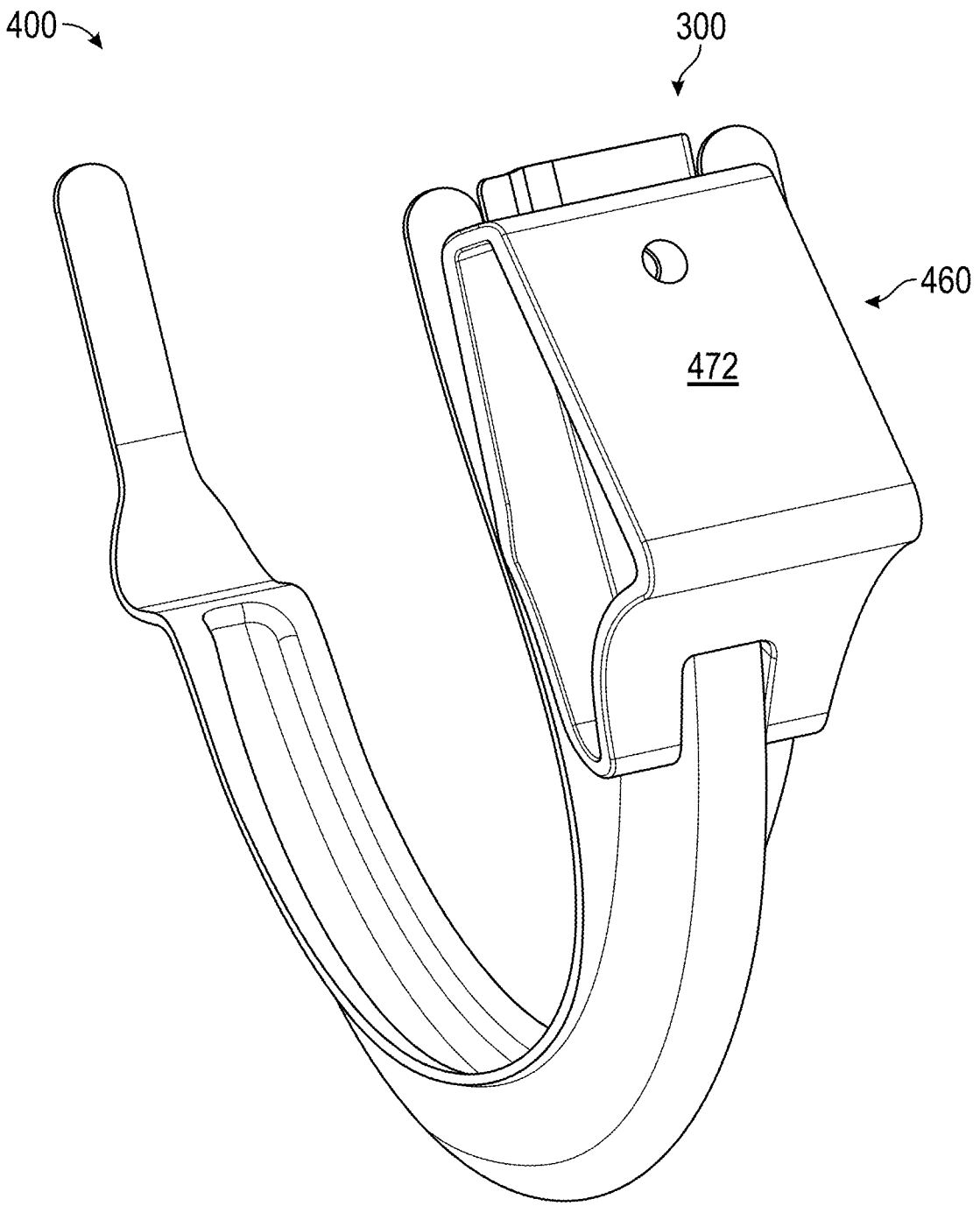
FIG. 18 is an example illustration of an embodiment of the gutter bracket system.

FIG. 18 is an example illustration of an embodiment of a gutter bracket system 400. Gutter bracket system 400 may include one or more gutter brackets (e.g., gutter bracket 300 as described with reference to FIG. 15) and a wedge 460, and may cooperate with, or may include, fasteners, gutter sections, and/or additional gutter system hardware. Features of the shown embodiment of gutter bracket system 400 may be similar to features described elsewhere herein, e.g. with respect to the gutter bracket system 200 of FIG. 2. In some cases, the structure where gutter bracket system 400 is to be mounted may have an angled surface (e.g., the surface may be angled away from vertical). Wedge 460 may be configured for mounting to the angled surface, and may have an angled face 472 that is configured to contact the structure (see also FIG. 21, where angled face 472 is shown offset from vertical by an angle θ). A bracket engaging portion 462 (see FIG. 19) may be shaped and dimensioned to receive a mounting portion 310 of gutter bracket 300. Bracket engaging portion 462 may include a mating face 464 that is configured for substantially vertical orientation when wedge 460 is mounted on the structure. A fastener (e.g., fastener 290 of FIG. 2) may be passed through both gutter bracket 300 and wedge 460 and fastened to the structure.

Figure 19:
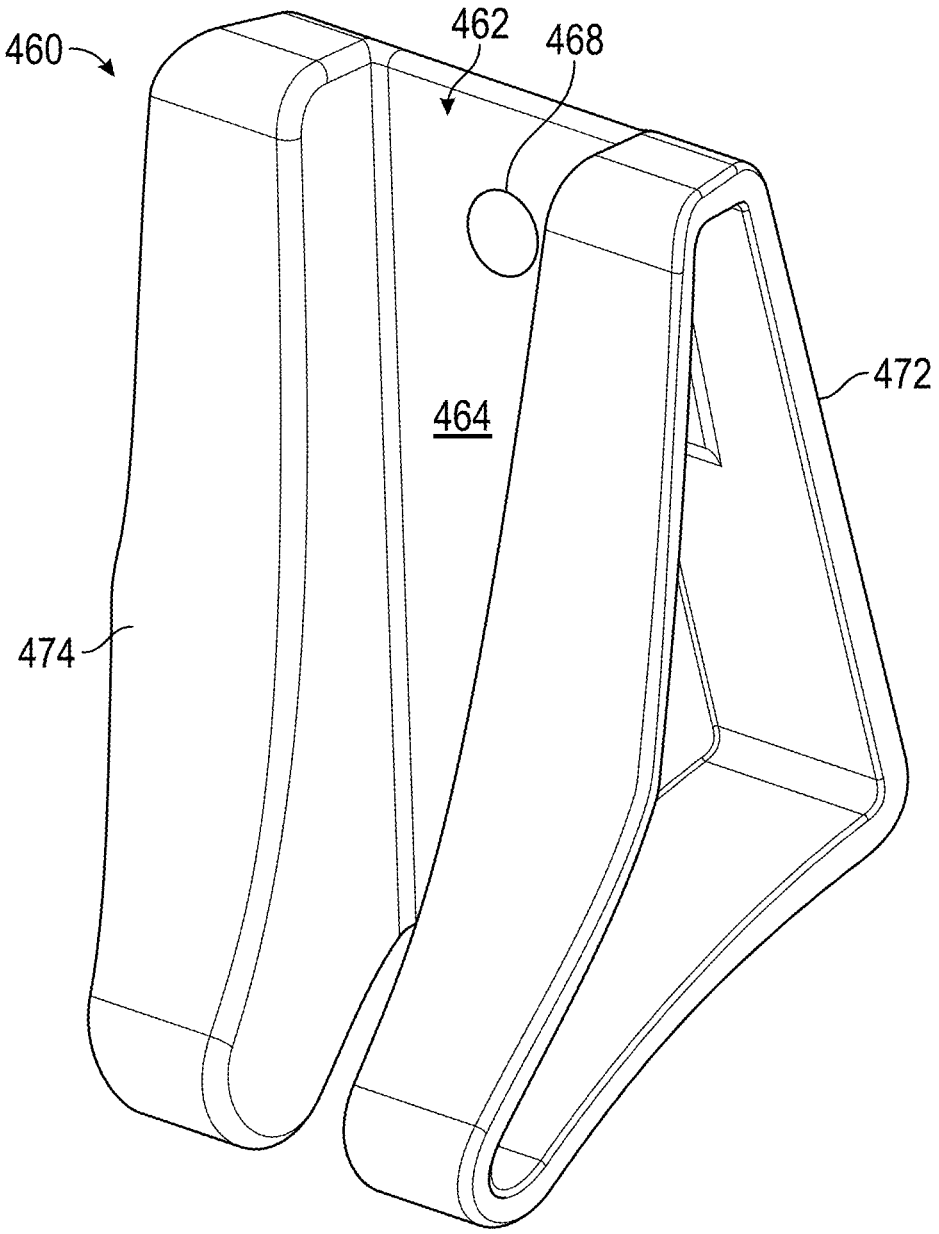
FIG. 19 is an example illustration of a perspective view of an embodiment of a wedge of the gutter bracket system.
Figure 20:
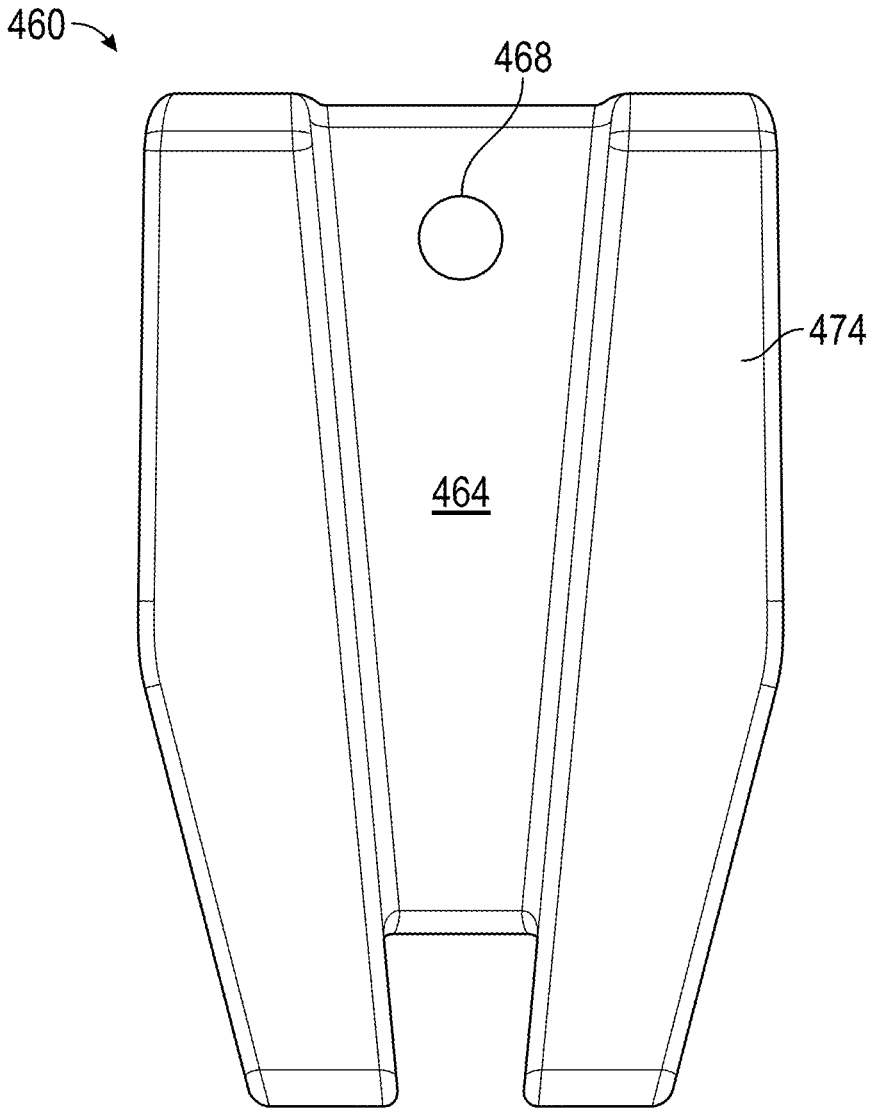
FIG. 20 is an example illustration of a front view of an embodiment of the wedge of the gutter bracket system.
Figure 21:
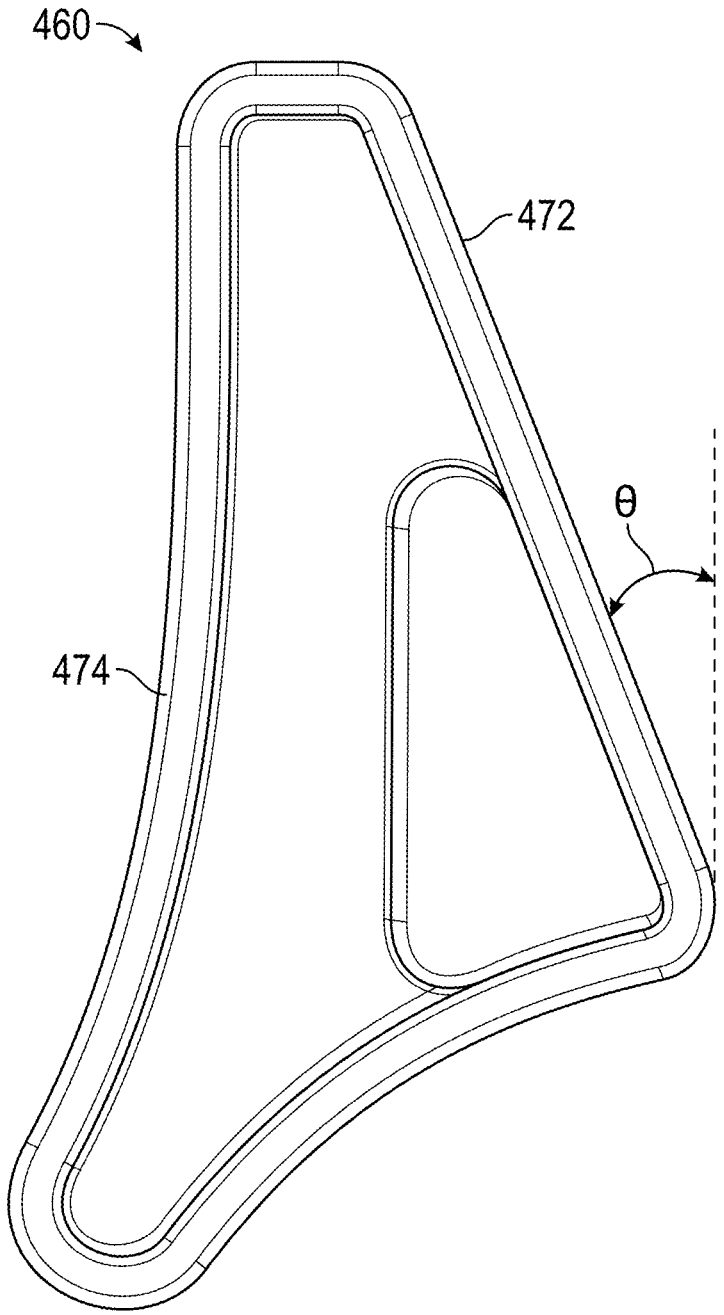
FIG. 21 is an example illustration of a side view of an embodiment of the wedge of the gutter bracket system.

FIGS. 19-21 are example illustrations of perspective, front, and side views, respectively, of an embodiment of wedge 460. Wedge 460 may include one or more of the following features: a bracket engaging portion 462, a mating face 464, a through hole 468, an angled face 472, and/or a sidewalls 474. Bracket engaging portion 462 may include one or more features as described with reference to FIG. 18. In addition, or instead, bracket engaging portion 462 may be shaped substantially complementary to at least a portion of mounting portion 310 of gutter bracket 300. Bracket engaging portion 462 is generally forward facing and provides a substantially vertical mating face 464 which mounting surface 312 of gutter bracket 300 may contact when gutter bracket system 400 is installed. Sidewalls 474 may extend forwardly from mating face 464, and may resist pivoting of the bracket. In some cases, sidewalls 474 may be curved and structurally configured to support the two wings 324 of gutter bracket 300.

Angled face 472 of wedge 460 is rearwardly oriented when the system is installed (in other words, oriented toward the structure). The angle, θ, of angled face 472 (with respect to vertical) may generally be selected to correspond to an angle of the structure where the system is to be installed. In embodiments, angled face 472 may have an angle of about 7.5, 15, 22.5, 30, 37.5, or 45 degrees offset from vertical, although other angles may be used as desired for the application. In some cases, wedge 460 may not have an angled face (e.g., the rear face of wedge 460 may be substantially vertical); such a configuration may be used to provide an offset between the gutter and the structure.

Wedge 460 may be manufactured by processes such as injection molding, 3D printing, polymer casting, or others known in the art. Wedge 460 may be constructed, for example, of a high-strength plastic material.

The embodiments of the gutter bracket, systems, and methods of use described herein are exemplary and numerous modifications, combinations, variations, and rearrangements can be readily envisioned to achieve an equivalent result, all of which are intended to be embraced within the scope of the appended claims. Further, nothing in the above-provided discussions of the gutter bracket, systems, and methods should be construed as limiting the invention to a particular embodiment or combination of embodiments. The scope of the invention is defined by the appended claims.

I claim:

1. A gutter bracket structurally configured to cooperate with a structure and a half round gutter having a front edge, the gutter bracket comprising:

a mounting portion including a substantially flat mounting surface offset rearwardly from one or more rear gutter retaining tabs with the one or more rear gutter retaining tabs in an unbent position, a the substantially flat mounting surface extending substantially vertically below the one or more rear gutter retaining tabs for abutting the structure;

a gutter supporting portion shaped and dimensioned to receive the half round gutter;

a rib in the gutter supporting portion;

two wings arranged with the rib therebetween, the two wings configured to contact the half round gutter;

wherein the rib extends downwardly below the two wings; and a front gutter retaining portion extending forwardly from the gutter supporting portion.

2. The gutter bracket of claim 1, wherein the rib is open upwardly between the two wings.

3. The gutter bracket of claim 1, further including one or more holes located at a low area of the gutter supporting portion.

4. The gutter bracket of claim 1, wherein the two wings extend along an entire length of the gutter supporting portion.

5. The gutter bracket of claim 1, wherein the one or more rear gutter retaining tabs include two rear gutter retaining tabs, each rear gutter retaining tab tapering inwardly and abutting one of the two wings.

6. The gutter bracket of claim 1, further including the one or more rear gutter retaining tabs including two rear gutter retaining tabs each abutting one of the two wings and a slit located adjacent each rear gutter retaining tab, the slit having a slit bottom and an open slit top.

7. The gutter bracket of claim 1, wherein the gutter supporting portion has a substantially semi-circular cross-section.

8. The gutter bracket of claim 1, wherein the gutter bracket is unitarily formed.

9. A gutter bracket structurally configured to cooperate with a structure and a half round gutter having a front edge, the gutter bracket comprising:

a mounting portion including a substantially flat mounting surface offset rearwardly from one or more rear gutter retaining tabs with the one or more rear gutter retaining tabs in an unbent position, a the substantially flat mounting surface extending substantially vertically below the one or more rear gutter retaining tabs for abutting the structure, and two sidewalls adjacent the mounting surface;

a gutter supporting portion shaped and dimensioned to receive the half round gutter;

a rib in the gutter supporting portion;

two wings arranged with the rib therebetween, the two wings configured to contact the half round gutter;

wherein the two sidewalls are inwardly tapered from a bracket top to the rib; and a front gutter retaining portion extending forwardly from the gutter supporting portion.

10. The gutter bracket of claim 9, wherein the rib is open upwardly between the two wings.

11. The gutter bracket of claim 9, wherein the rib extends downwardly below the two wings.

12. The gutter bracket of claim 9, further including: a mounting aperture in the mounting surface.

13. The gutter bracket of claim 9, wherein the mounting surface is substantially flat along a distance extending below an upper rear edge of the two wings.

14. A gutter bracket structurally configured to cooperate with a structure and a half round gutter having a front edge, the gutter bracket comprising:

a mounting portion including a substantially flat mounting surface offset rearwardly from one or more rear gutter retaining tabs with the one or more rear gutter retaining tabs in an unbent position, a the substantially flat mounting surface extending substantially vertically below the one or more rear gutter retaining tabs for abutting the structure;

a gutter supporting portion shaped and dimensioned to receive the half round gutter;

a rib in the gutter supporting portion;

two wings arranged with the rib therebetween, the two wings having a curvature shaped to conform to the half round gutter; and a front gutter retaining portion extending forwardly from the gutter supporting portion.

15. The gutter bracket of claim 14, further including two sidewalls adjacent the mounting surface, wherein the two sidewalls are inwardly tapered from a bracket top to the rib.

16. The gutter bracket of claim 14, wherein the rib is open upwardly between the two wings.

17. The gutter bracket of claim 14, wherein the two wings extend along an entire length of the gutter supporting portion.

* * * * *